US009389546B2

(12) United States Patent
Birumachi

(10) Patent No.: US 9,389,546 B2
(45) **Date of Patent: *Jul. 12, 2016**

(54) IMAGE FORMING APPARATUS WITH INTERMEDIATE TONER TRANSFER MEDIUM, CONTROL METHOD THEREFOR, AND STORAGE MEDIUM STORING CONTROL PROGRAM THEREFOR

(71) Applicant: CANON KABUSHIKI KAISHA, Tokyo (JP)

(72) Inventor: Takashi Birumachi, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/740,648

(22) Filed: Jun. 16, 2015

(65) Prior Publication Data

US 2015/0277302 A1 Oct. 1, 2015

Related U.S. Application Data

(63) Continuation of application No. 13/869,077, filed on Apr. 24, 2013, now Pat. No. 9,081,344.

(30) Foreign Application Priority Data

Apr. 27, 2012 (JP) ..... 2012-102874

(51) Int. Cl.
*G03G 15/00* (2006.01)
*G03G 15/01* (2006.01)
*G03G 15/16* (2006.01)

(52) U.S. Cl.
CPC ..... *G03G 15/1615* (2013.01); *G03G 15/505* (2013.01); *G03G 15/5008* (2013.01); *G03G 15/5033* (2013.01); *G03G 2215/00075* (2013.01); *G03G 2215/0129* (2013.01)

(58) Field of Classification Search
CPC ..... G03G 15/757; G03G 15/1615; G03G 15/5008; G03G 15/505; G03G 2215/00075
See application file for complete search history.

(56) References Cited

U.S. PATENT DOCUMENTS 8,417,162 B2 4/2013 Matsuo
9,081,344 B2 * 7/2015 Birumachi ..... G03G 15/1615

FOREIGN PATENT DOCUMENTS

JP 62178982 A 8/1987
JP 04324881 A 11/1992

(Continued)

OTHER PUBLICATIONS

Quayle Action issued in U.S. Appl. No. 13/869,077, mailed Dec. 31, 2014.
Notice of Allowance issued in U.S. Appl. No. 13/869,077, mailed Mar. 10, 2015.

(Continued)

*Primary Examiner* — William J Royer
(74) *Attorney, Agent, or Firm* — Rossi, Kimms & McDowell LLP

(57) ABSTRACT

An image forming apparatus that is capable of reducing velocity fluctuation due to variation of friction torque between an image bearing member and an intermediate transfer medium depending on a toner image. An exposure unit forms a latent image on the image bearing member rotated by a first drive unit. A development unit develops the latent image to form a toner image. A primary transfer unit transfers the toner image to an intermediate transfer medium rotated by a second drive unit. A secondary transfer unit transfers the toner image to a sheet. A control unit controls the drive units so that a peripheral velocity difference between the image bearing member and the intermediate transfer medium becomes a first value at starting, and controls so that the peripheral velocity difference becomes a second value larger than the first value when minute toner reaches the position of the primary transfer unit.

13 Claims, 10 Drawing Sheets

(56) References Cited

FOREIGN PATENT DOCUMENTS

| | | | |
|---|---|---|---|
| JP | 06317992 | A | 11/1994 |
| JP | 2006189614 | A | 7/2006 |

OTHER PUBLICATIONS

Official Action issued in Japanese Appln. No. 2012102874 mailed Mar. 15, 2016.

* cited by examiner

IMAGE FORMING APPARATUS WITH INTERMEDIATE TONER TRANSFER MEDIUM, CONTROL METHOD THEREFOR, AND STORAGE MEDIUM STORING CONTROL PROGRAM THEREFOR

BACKGROUND OF THE INVENTION

1. Field of the Invention

The present invention relates to an image forming apparatus that primarily transfers a toner image formed on an image bearing member to an intermediate transfer medium and secondarily transfers the toner image on the intermediate transfer medium to a sheet. Particularly, the present invention relates to velocity control of the image bearing member and the intermediate transfer medium.

2. Description of the Related Art

Conventionally, a color image forming apparatus of an electrophotographic system, such as a color copier, forms toner images on surfaces of image bearing members (photosensitive drums) for respective colors, and primarily transfers these toner images to an intermediate transfer medium. Then, the superimposed toner images that are primarily transferred to the intermediate transfer medium are secondarily transferred to a sheet to form a color image.

In such an image forming apparatus, in order to prevent deviation (color misregistration) among the color toner images, it is necessary to keep the peripheral velocities of the photosensitive drums constant and to keep the peripheral velocity of the intermediate transfer medium constant. Japanese Laid-Open patent publication (Kokai) No. S62-178982 (JP S62-178982A) discloses a technique that controls angular velocity of a drum shaft with a feedback control on a DC motor as a driving source using a rotational velocity sensor arranged on the drum shaft of a photosensitive drum in order to rotate the photosensitive drum at a constant velocity.

In the configuration where toner images formed on the photosensitive drums are transferred to the intermediate transfer medium, it is preferable that the relative velocity (peripheral velocity difference) between the photosensitive drums and the intermediate transfer medium becomes zero in consideration of an effect on image expansion and contraction of the image. However, even if the angular velocity of the drum shaft is controlled with the technique disclosed in JP S62-178982A, the velocity fluctuation due to mechanical shape errors, such as backlash of gears, error in roundness and eccentricity of the photosensitive drum, cannot be avoided. Then, if such velocity fluctuation causes the peripheral velocity difference, friction torque will occur between the photosensitive drum and the intermediate transfer medium, and this friction torque will cause further velocity fluctuation. When the velocity of either of the photosensitive drum and the intermediate transfer medium varies under the condition where the peripheral velocity difference is set so as to become zero especially, the large and small relation of the peripheral velocities (namely, plus/minus sign of the peripheral velocity difference) is not fixed, which enlarges the range of fluctuation of the friction torque caused therebetween.

In order to control bad influence of the velocity fluctuation, Japanese Laid Open Patent Publication (Kokai) No. H4-324881 (JP H4-324881A) discloses a technique that always generates one way friction torque by setting the peripheral velocity of the photosensitive drum being higher than that of the intermediate transfer medium. Thereby, even if the velocity fluctuation occurs, the large and small relation of the peripheral velocities is fixed, which enables to control color misregistration by making the range of fluctuation of the friction torque small.

Moreover, Japanese Laid-Open Patent Publication (Kokai) No. H6-317992 (JP H6-317992A) discloses a technique that sets the peripheral velocity of the intermediate transfer medium being higher than that of a photosensitive drum in order to improve transcriptional efficiency.

However, when the peripheral velocity difference is set between the photosensitive drum and the intermediate transfer medium as mentioned above, a slower one of the photosensitive drum and the intermediate transfer medium in the peripheral velocity is pulled by the other of which the peripheral velocity is faster, which decreases the drive torque of the motor of the slower one. When a toner image arrives at a primary transfer unit under such a condition, since the friction torque between the photosensitive drum and the intermediate transfer medium increases, the decreased driving torque of the motor sharply increases, which greatly changes the peripheral velocity of the slower one of the photosensitive drum and the intermediate transfer medium for a while. That is, when the toner image arrives at the primary transfer unit in an image formation starting period and when the toner image goes away from the primary transfer unit in an image formation ending period, the friction torque varies sharply, which greatly fluctuates the rotational velocity of a DC motor that is a driving source. The velocity fluctuation may cause a remarkable color misregistration image.

SUMMARY OF THE INVENTION

The present invention provides an image forming apparatus, a control method therefor, and a storage medium storing a control program therefor, which are capable of reducing velocity fluctuation due to variation of friction torque between a photosensitive drum and an intermediate transfer medium depending on a toner image, and of preventing color misregistration.

Accordingly, a first aspect of the present invention provides an image forming apparatus comprising an exposure unit configured to form a latent image on an image bearing member, a development unit configured to develop the latent image to form a toner image, a primary transfer unit configured to transfer the toner image formed on the image bearing member to an intermediate transfer medium, a secondary transfer unit configured to transfer the toner image transferred to the intermediate transfer medium to a sheet, a first drive unit configured to rotate the image bearing member, a second drive unit configured to rotate the intermediate transfer medium, and a control unit configured to control the first and second drive units so that a peripheral velocity difference between the image bearing member and the intermediate transfer medium becomes a first value at starting, and configured to control the first and second drive units so that the peripheral velocity difference becomes a second value larger than the first value when minute toner, which is not recognized as an image and is adhered to the image bearing member by starting the development unit, reaches the position of the primary transfer unit.

Accordingly, a second aspect of the present invention provides an image forming apparatus comprising an exposure unit configured to form a latent image on an image bearing member, a development unit configured to develop the latent image to form a toner image, a primary transfer unit configured to transfer the toner image formed on the image bearing member to an intermediate transfer medium, a secondary transfer unit configured to transfer the toner image transferred to the intermediate transfer medium to a sheet, a first drive unit configured to rotate the image bearing member, a second drive unit configured to rotate the intermediate transfer medium, and a control unit configured to control the first and second drive units so that peripheral velocities of the image bearing member and the intermediate transfer medium become equal at starting, then, to start the development unit before starting the exposure unit after a predetermined period from the start of the development unit, and to control the first and second drive units so as to increase at least one of the peripheral velocities of the image bearing member and the intermediate transfer medium during image formation.

According to the present invention, the velocity fluctuation due to variation of the friction torque between the photosensitive drum and the intermediate transfer medium depending on toner can be reduced, and the color misregistration can be prevented.

Further features of the present invention will become apparent from the following description of exemplary embodiments with reference to the attached drawings.

DESCRIPTION OF THE EMBODIMENTS

Hereafter, embodiments according to the present invention will be described in detail with reference to the drawings.

An outline of the present invention will be described. Peripheral velocity difference between a photosensitive drum and an intermediate transfer medium is controlled to be a predetermined value (zero in the following embodiment) during starting for forming an image. A development device is started before starting an exposure process, and minute toner at a level that is not recognized as an image is adhered to the photosensitive drum. The peripheral velocity difference is increased after this minute toner arrived at a primary transferring position, and the peripheral velocity difference is controlled so as to become the predetermined value of the starting again at the time of finishing the image formation. Since the minute toner reduces frictional force between the photosensitive drum and the intermediate transfer medium, a slower one of the photosensitive drum and the intermediate transfer medium in the peripheral velocity is not pulled by the other of which the peripheral velocity is faster even if the peripheral velocity difference increases, which maintains torques of motors that drive them. Accordingly, even when a toner image arrives at the primary transferring position and the friction torque increases, the torque fluctuations of the motors are small, which suppresses the variations of the peripheral velocities and reduces color misregistration.

Figure 1:
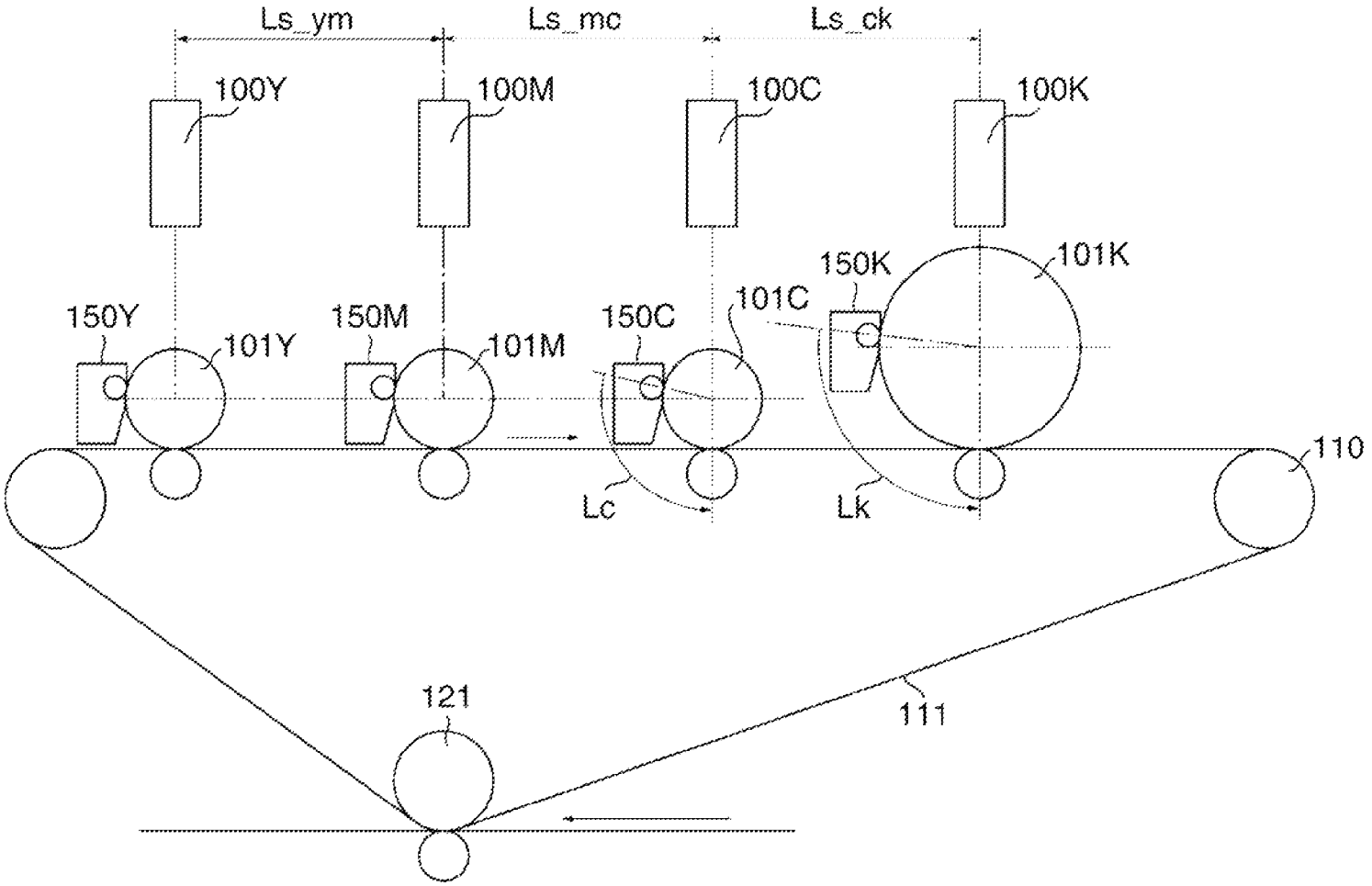
FIG. 1 is a view showing a configuration of an image forming apparatus according to an embodiment of the present invention.

FIG. 1 is a view showing a configuration of an image forming apparatus according to an embodiment of the present invention.

This image forming apparatus is constituted as a color electrophotographic copying machine of a tandem system. That is, the image forming apparatus is provided with image forming units for four colors of yellow (referred to as Y hereinafter), magenta (referred to as M hereafter), cyan (referred to as C hereafter), and black (referred to as K hereafter).

This image forming apparatus is provided with photosensitive drums 101 (101Y, 101M, 101C, and 101K) as image bearing members on which electrostatic latent images of the colors Y, M, C, and K are formed, respectively. The image forming apparatus is provided with laser scanners 100 (100Y, 100M, 100C, and 100K) that expose the photosensitive drums 101 to form electrostatic latent images. Furthermore, the image forming apparatus has development devices 150 (150Y, 150M, 150C, and 150K) that develop the electrostatic latent images formed on the photosensitive drums 101 to form respective color toner images.

The image forming apparatus is provided with an intermediate transfer belt 111 as an intermediate transfer medium to which the toner images formed on the photosensitive drums 101 are piled one by one to be primarily transferred. The intermediate transfer belt 111 is made from elastic material. Furthermore, the image forming apparatus has an intermediate transfer drive roller 110 that rotates the intermediate transfer belt 111, and a secondary transfer roller 121 that secondarily transfers the piled toner images formed on the intermediate transfer belt 111 to a recording sheet conveyed as a transfer sheet at a time. Henceforth, the intermediate transfer belt 111 will be abbreviated to "ITB".

Figure 2:
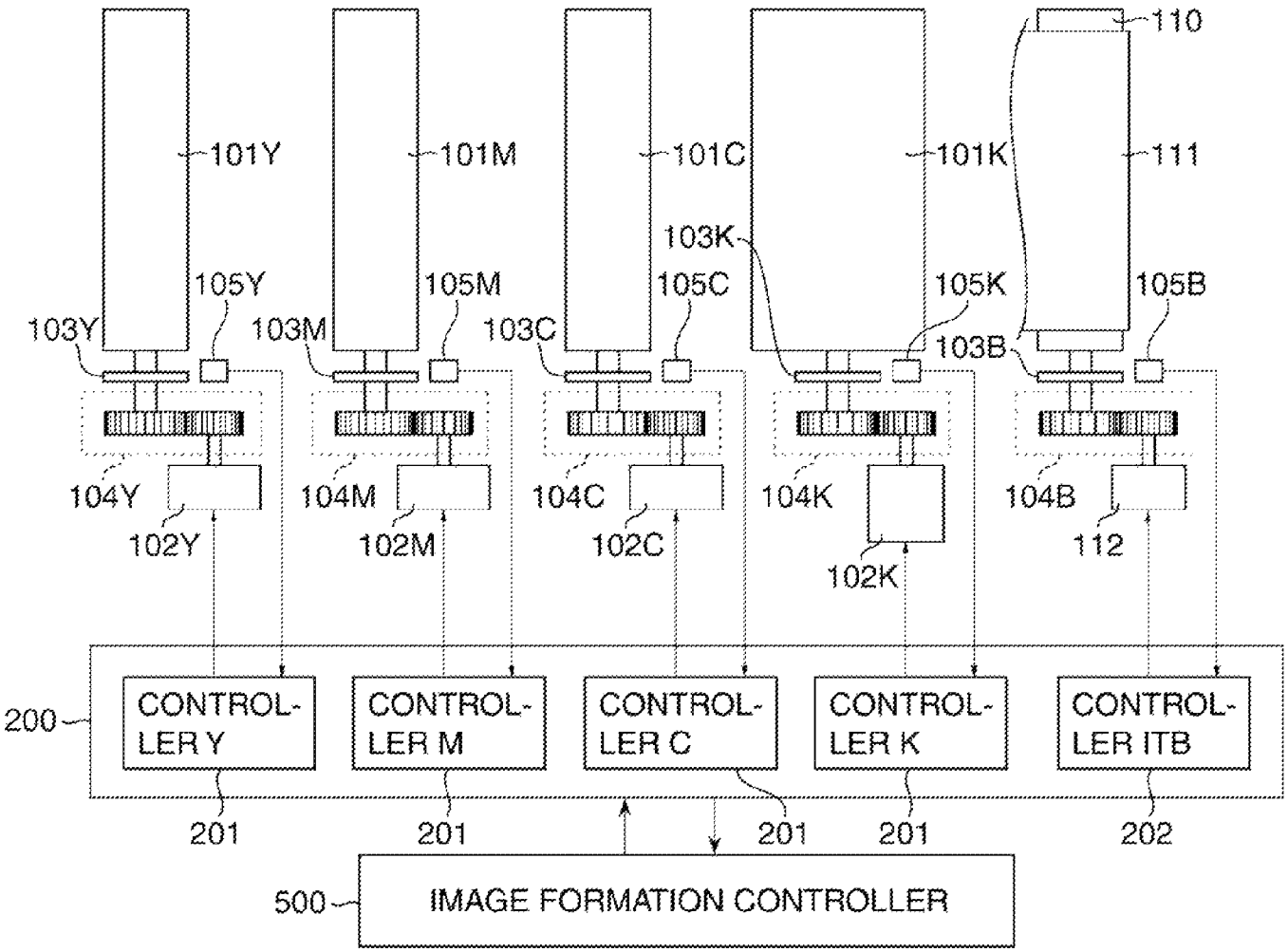
FIG. 2 is a view schematically showing configurations of motor drive control units for photosensitive drums and an intermediate transfer drive roller of the image forming apparatus shown in FIG. 1.

FIG. 2 is a view schematically showing configurations of drive units for the photosensitive drums 101 and the intermediate transfer drive roller 110.

The image forming apparatus has drive motors 102 (102Y, 102M, 102C, and 102K) as independent first driving units for driving the photosensitive drums 101, respectively. Furthermore, the image forming apparatus has a drive motor 112 as a second driving unit for rotating the intermediate transfer drive roller 110. All of the drive motors 102 and 112 are brushless DC motors.

Drive shafts of the drive motors 102 are connected to the rotating shafts of the corresponding photosensitive drums 101 via reduction gears 104 (104Y, 104M, 104C, and 104K) that slow down a rotational frequency to a predetermined rotational frequency. The drive shaft of the drive motor 112 is connected to the driving shaft of the intermediate transfer drive roller 110 via reduction gear 104B that slows down a rotational frequency to a predetermined rotational frequency.

Moreover, wheel scales 103 (103Y, 103M, 103C, 103K, and 103B) on which optical patterns (slits) are formed are attached to the rotating shafts of the photosensitive drums 101 and the drive shaft of the intermediate transfer drive roller 110 in order to detect angular velocities. Moreover, encoder sensors 105 (105Y, 105M, 105C, 105K, and 105B) are located opposite to rotation centers of the respective wheel scales 103 for detecting inter slit periods.

Flywheels (not shown) for stabilizing rotations are attached to the rotating shaft of the photosensitive drums 101 at the opposite end of the wheel scales 103.

The image forming apparatus has a motor drive control unit 200 and an image formation controller 500. The image formation controller 500 controls entire operation of the image forming apparatus. The motor drive control unit 200 is provided with controllers 201 (Y, M, C, and K) and 202 (ITB) that control the corresponding drive motors 102 and 112. The motor drive control unit 200 and the image formation controller 500 collaborate to function as a control unit that controls the drive motors 102 and 112, and controls the rotational velocities of the photosensitive drums 101 and the intermediate transfer drive roller 110.

The drive motors 102 and 112 are controlled so that the photosensitive drums 101 and the intermediate transfer drive roller 110 rotate at predetermined velocities, respectively, based on information detected with the corresponding encoder sensors 105. The velocities (peripheral velocities) of the surfaces of the photosensitive drums 101 and the intermediate transfer belt 111, which contact with each other, are thereby controlled.

Figure 3:
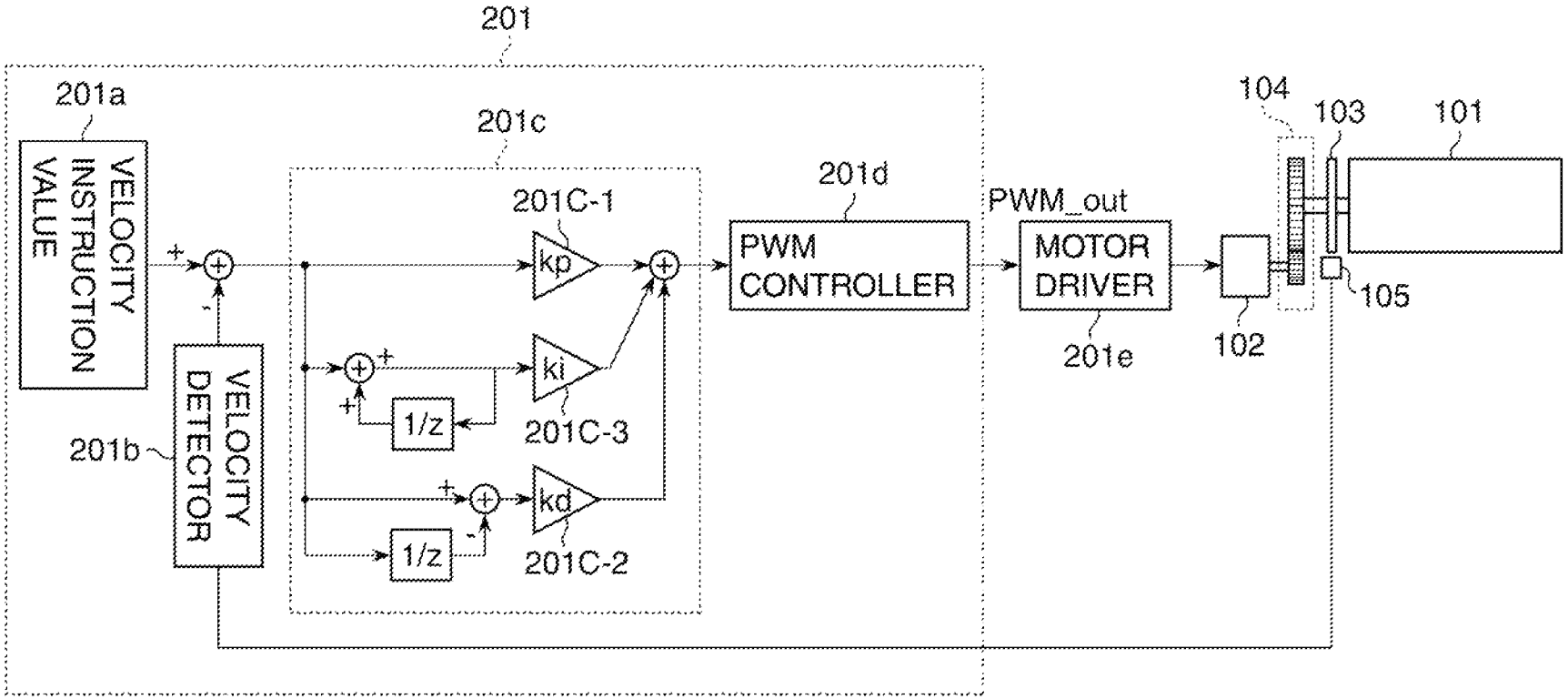
FIG. 3 is a block diagram schematically showing a configuration of a controller for a photosensitive drum in the motor drive control unit shown in FIG. 2.

The velocity control of a drive motor will be described with reference to FIG. 3. FIG. 3 is a block diagram schematically showing a configuration of the controller 201 for the photosensitive drum 101 in the motor drive control unit 200. Since the controller 202 for the intermediate transfer belt 111 is configured like the controller 201, an illustration and a description are omitted.

The controller 201 controls the velocity of the drive motor 102. Generally, a velocity of DC motor is controlled by controlling magnetic flux amount generated with a motor winding coil by adjusting magnitude of electric current that flows through the motor winding coil to change voltage of supplied electric current. Accordingly, a pulse width modulation control (referred to as a PWM control hereafter) that controls a duty ratio (a ratio between ON time and OFF time) of a direct current voltage supply by a switching means is applied in general. The velocity is controlled by this PWM control in this embodiment.

Specifically, the velocities of the drive motors 102 are controlled by the controllers 201 shown in FIG. 3 according to the following procedures of (a0) through (a4).

(a0) The controller 201 starts the control when a velocity instruction value 201*a* is set as a target velocity and an operation start instruction is received from the image formation controller 500.

(a1) A velocity detector 201*b* detects the velocity based on the inter slit period detected by the combination of the wheel scale 103 attached to the drive shaft of the photosensitive drum 101 as the driving target and the encoder sensor 105 that is arranged oppositely.

(a2) The controller 201 compares the detected velocity with the velocity instruction value 201*a* set from the image formation controller 500, and amplifies the difference result with a general PID controller 201*c*.

(a3) A PWM controller 201*d* generates a pulse signal PWM_out of the duty ratio corresponding to the control input calculated by the PID controller 201*c*.

(a4) A motor driver 201*e* controls the rotational velocity of the drive motor 102 by changing supply voltage to the drive motor 102 based on the pulse signal PWM_out.

The PID controller 201*c* is configured to add a proportional item 201C-1 that multiplies set up proportional gain Kp to the differential result and an integral term 201C-3 that multiplies an integration gain Ki to an integral item of a deviation by a one sample delay element (1/z). Furthermore, the differential result is amplified based on a differentiation item 201C-2 that multiplies rate gain Kd to a deviation by a one sample delay element (1/z), and these items are added and outputted. Moreover, the calculation process is executed based on the detected velocity that is read at the predetermined sampling intervals.

Figure 4:
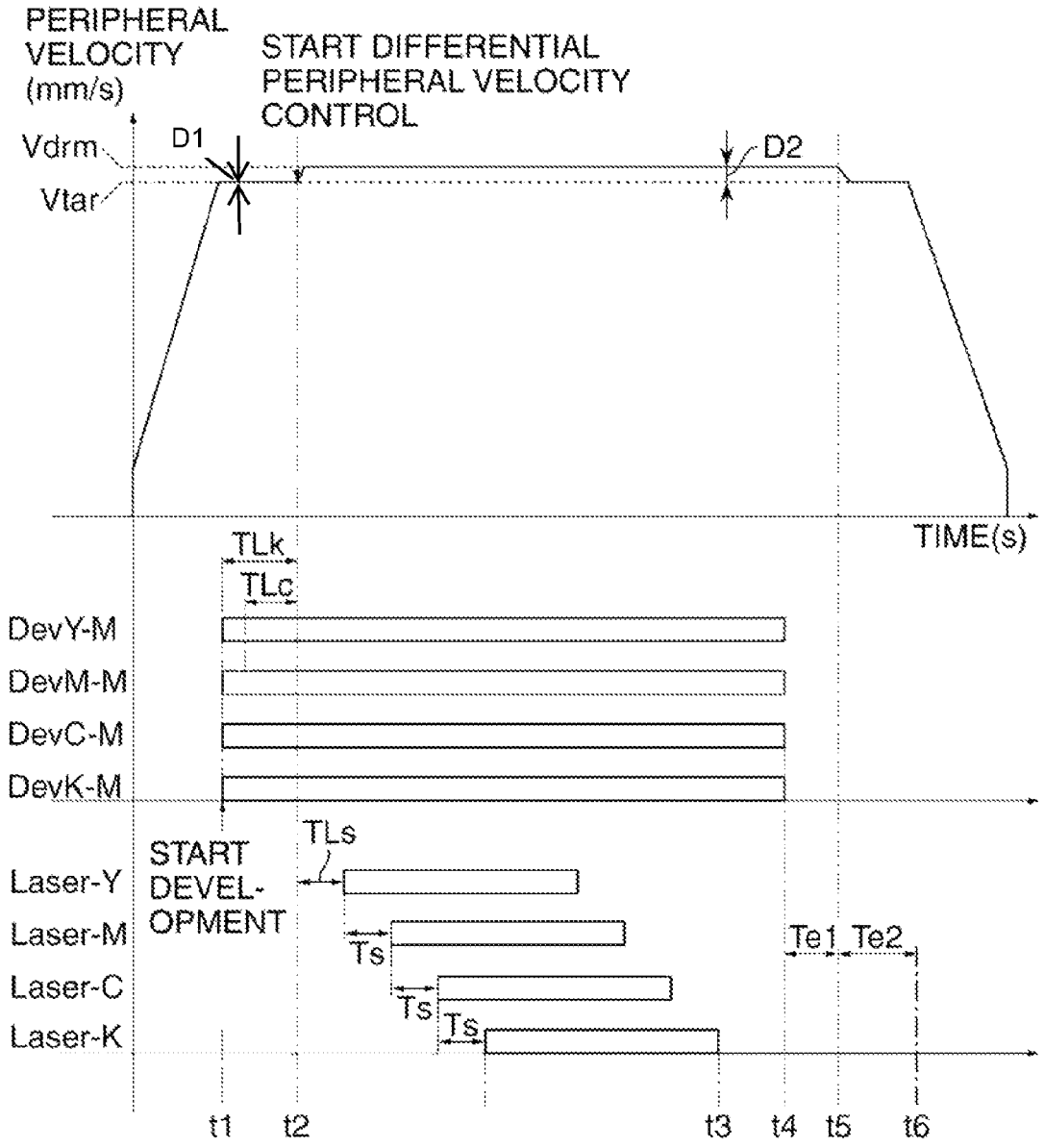
FIG. 4 is a time chart showing an image forming operation of the image forming apparatus shown in FIG. 1.

FIG. 4 is a time chart showing an image forming operation of the image forming apparatus shown in FIG. 1.

In FIG. 4, Dev (Y, M, C, and K)-M show drive states of development motors that drive the development devices 150 for the respective colors, and Laser-(Y, M, C, and K) show exposed states by the laser scanners 100 (Y, M, C, and K).

The timing at which a differential peripheral velocity control in the image forming operation is executed is generated with reference to the control start timing at the driving velocity that is set according to the image formation speed of the photosensitive drum 101 and the intermediate transfer belt 111.

When the image forming operation is started, the drive motors 102 and 112 are started by collaboration of the image formation controller 500 and the motor drive control unit 200. When the peripheral velocities of both the photosensitive drum 101 and the intermediate transfer belt 111 reach a standard target velocity Vtar (at a point in time t1), a constant velocity control is executed so that the peripheral velocity difference becomes zero (a first value D1) and that the standard target velocity Vtar becomes a common constant velocity. This is hereafter called a "common constant velocity control". At the same time, the development motors of the respective colors start. It should be noted that the development motors are started for driving in synchronization with the exposure process of the laser scanners in order to reduce unnecessary power consumption, in general. However, the development motors begin to be driven at the point t1 before starting the exposure process in this embodiment in order to give minute toner at a level that is not recognized as an image to the photosensitive drums 101.

When a predetermined period TLk elapses from the point t1 (at a point t2), the system shifts to the differential peripheral velocity control that sets the target value of the peripheral velocity difference between the photosensitive drum 101 and the intermediate transfer belt 111 to the setting peripheral velocity difference D2 (a second value). Specifically, the target value of the peripheral velocity of the photosensitive drum 101 increases to a drum velocity Vdrm that is faster than the standard target velocity Vtar while keeping the target value of the peripheral velocity of the intermediate transfer belt 111 at the standard target velocity Vtar. Accordingly, the motors are controlled at the constant velocities in an image formation period so that the peripheral velocity difference becomes the setting peripheral velocity difference D2. This is called a "differential peripheral velocity control" hereafter. The "image formation period" is defined as a period between the exposure start by the laser scanner 100Y and the completion of the primary transfer of the toner image on the photosensitive drum 101K to the intermediate transfer belt 111.

The predetermined period TLk is duration between the formation of the toner image on the photosensitive drum 101K and the arrival of the toner image concerned to a position (a primary transferring position) where the toner image is primarily transferred to the intermediate transfer belt 111 according to rotation of the photosensitive drum 101K. The distance Lk along the circumference between the image forming position and the primary transferring position is illustrated in FIG. 1. The predetermined period TLk is calculated beforehand and stored in the storage unit (not shown) of the image formation controller 500 with the information about the setting peripheral velocity difference D2 and other various values. Since the predetermined period TLk has elapsed at this point in time, the minute toner on the photosensitive drum 101K reaches the primary transferring position, which decreases the friction torque between the photosensitive drum 101K and the intermediate transfer belt 111. For this reason, even if the differential peripheral velocity control is started, the intermediate transfer belt 111 is not pulled by the photosensitive drum 101K. Accordingly, the intermediate transfer belt 111 and the photosensitive drum 101K rotate at the respective different peripheral velocities, which maintains torques of the motors that drive them. Accordingly, even when a toner image arrives at the primary transferring position and the friction torque increases, the torque fluctuations of the motors are small, which suppresses the variations of the peripheral velocities and reduces color misregistration.

A period TLc shown in FIG. 4 is a duration between the formation of the toner image on the photosensitive drum 101C and the arrival of the toner image concerned to the position (the primary transferring position) where the toner image is primarily transferred to the intermediate transfer belt 111. The distance Lc along the circumference between the image forming position and the primary transferring position is illustrated in FIG. 1. In the case of an image forming apparatus in which the period TLc is not smaller than the period TLk, the period from the point t1 to the point t2 may be equal to the period TLc.

After a stabilization period TLs for the differential peripheral velocity control elapses from the point t2, the exposure processes sequentially start from the laser scanner 100Y for every period Ts. The period Ts is calculated by dividing a distance Ls (Ls_ym, Ls_mc, or Ls_ck) between the adjacent primary transferring positions shown in FIG. 1 by the belt velocity Vitb. The exposure process by the laser scanner 100K is completed at a point t3.

When the image formation is finished, the driving of the development motors of respective colors stop (at a point t4). At a point t5 after a period Tel that is sufficient for finishing the image formation from the stops of the development motors at the point t4, the differential peripheral velocity control is changed to the common constant velocity control where both the peripheral velocities of the photosensitive drum 101 and the intermediate transfer belt 111 become the standard target velocity Vtar. When a period Te2 that is sufficient for converging the peripheral velocities of the photosensitive drum 101 and the intermediate transfer belt 111 to the standard target velocity has elapsed, the drive motors 102 and 112 stop.

Figure 7:
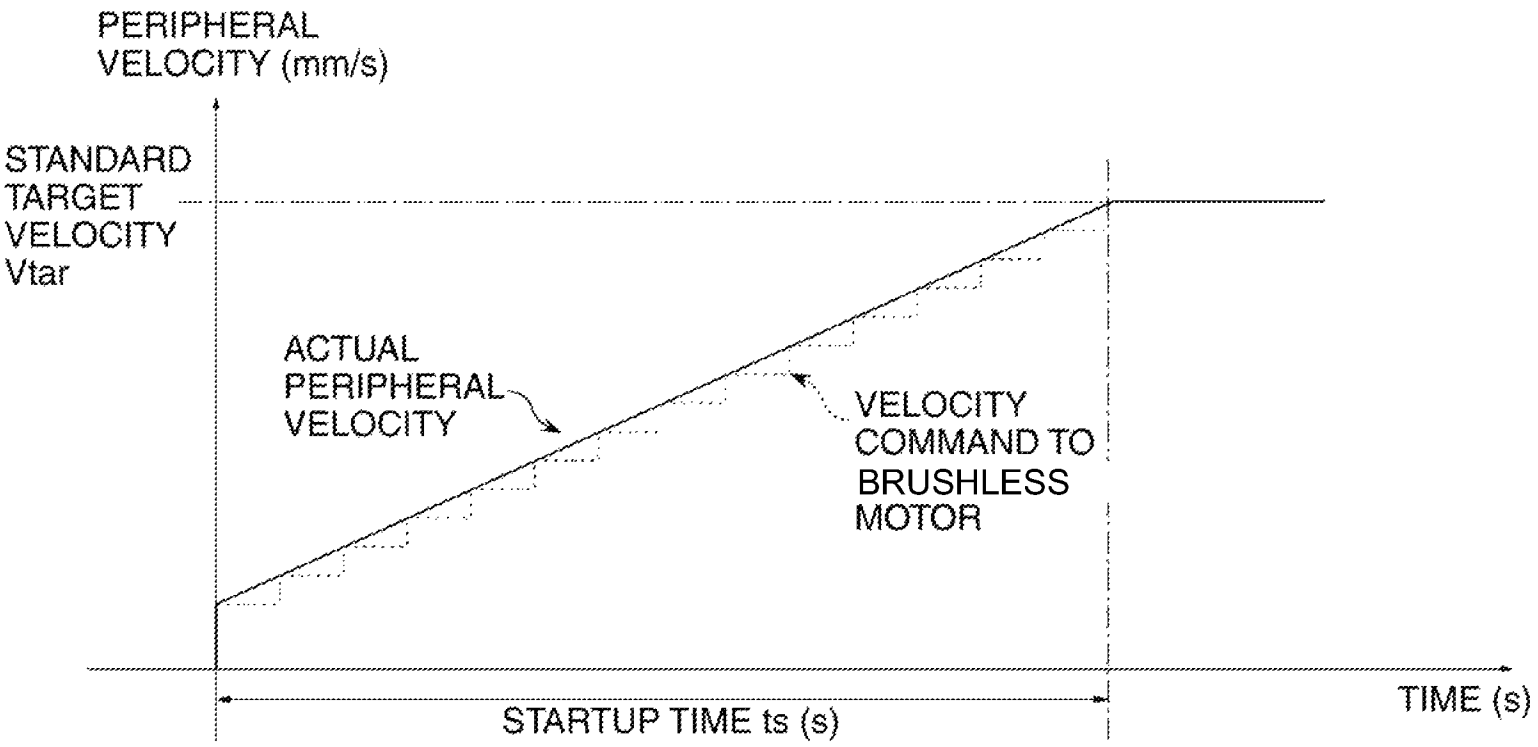
FIG. 7 is a graph showing velocity change in the case of changing a velocity instruction value in the controller shown in FIG. 3.

Next, more details of the image forming operation and the differential peripheral velocity control will be described using FIG. 5, through FIG. 7 in addition to FIG. 4.

Figure 5:
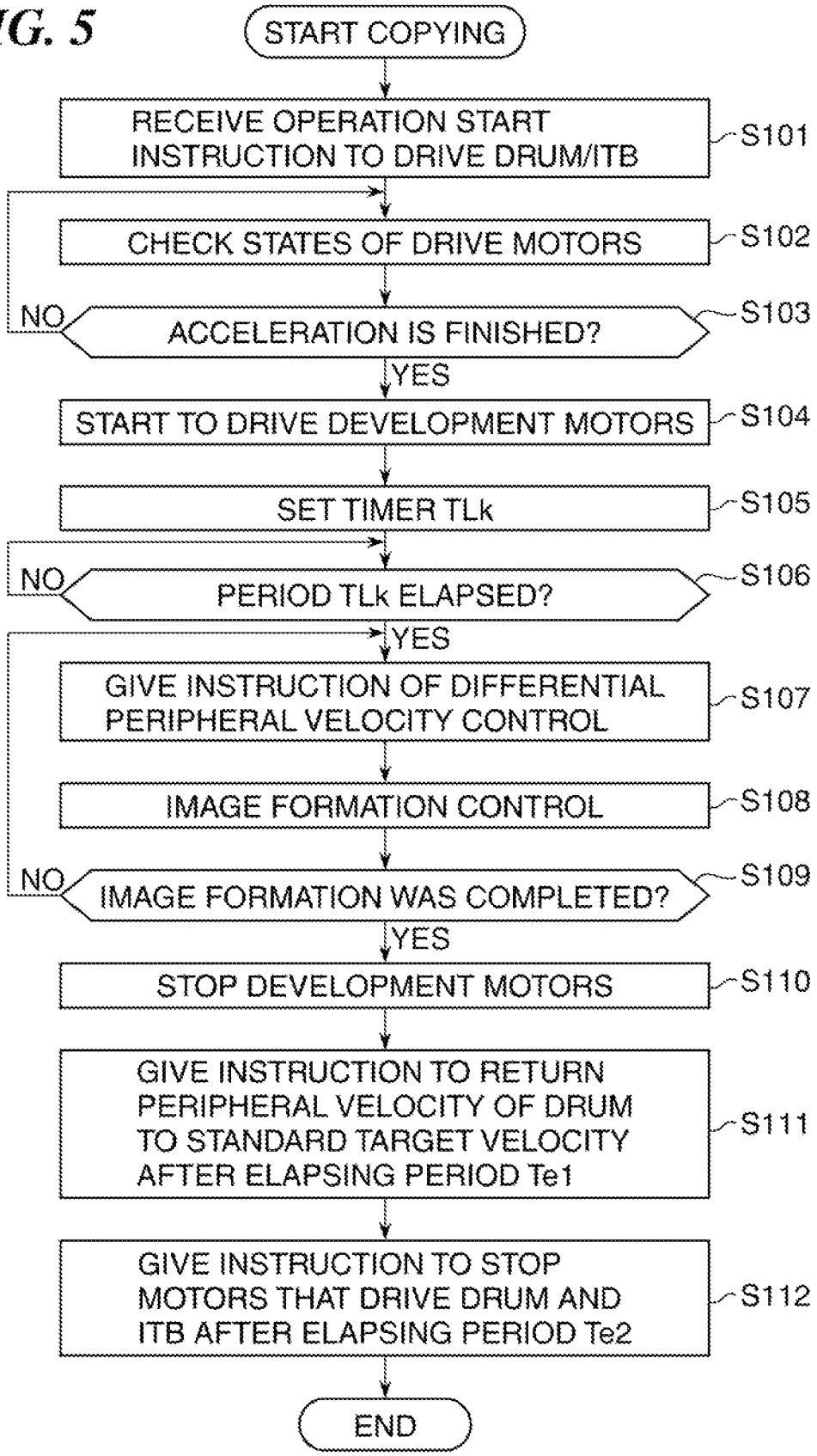
FIG. 5 is a flowchart showing the image forming operation executed by an image formation controller of the image forming apparatus shown in FIG. 1.
Figure 6:
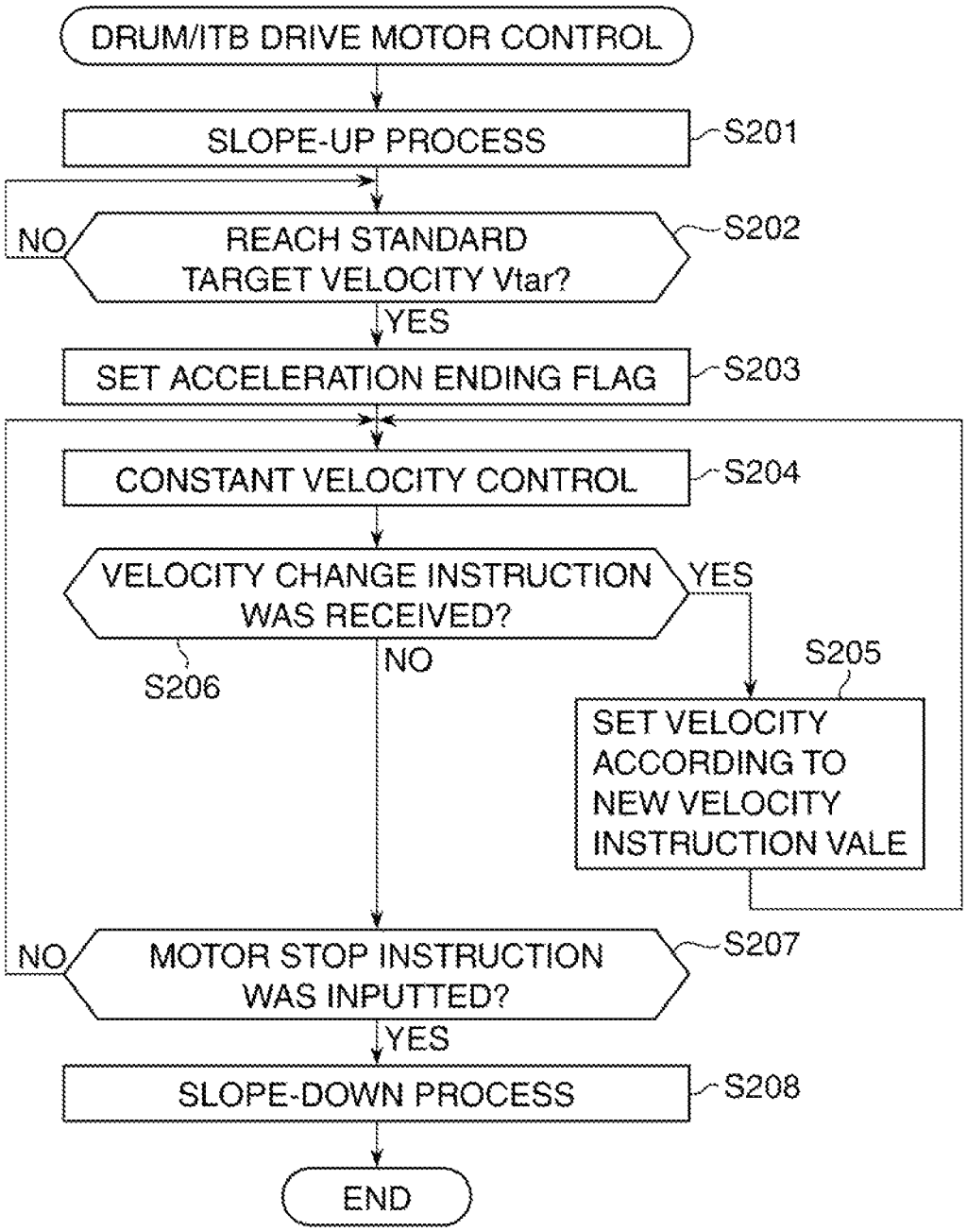
FIG. 6 is a flowchart showing a drum/ITB drive motor control process executed by the motor drive control unit in parallel to the image forming operation of the image forming apparatus shown in FIG. 1.

FIG. 5 is a flowchart showing the image forming operation executed by the image formation controller 500. FIG. 6 is a flowchart showing a drum/ITB drive motor control process executed by the motor drive control unit 200 in parallel to the image forming operation.

The image formation controller 500 and the motor drive control unit 200 are independent configurations, and the image forming operation and the differential peripheral velocity control during its operation are executed by communicating their states to each other. Moreover, the process shown in FIG. 6 is executed by independent operations of the controllers 201 (FIG. 3) in the motor drive control unit 200.

First, the drive and stop operations of the drive motors 102 and 112 by the motor drive control unit 200 will be described with reference to FIG. 6. This operation process is started when the velocity instruction value 201*a* is set as the target velocity and the operation start instruction is received from the image formation controller 500 (step S101 in FIG. 5) as mentioned above.

The drive motors 102 and 112 are started so that the peripheral velocity difference between the photosensitive drum 101 and the intermediate transfer belt 111 becomes about zero (0). Accordingly, the velocity instruction value 201*a* in the controller 201 (FIG. 3) is changed gradually as shown in FIG. 7 in order to keep constant acceleration at starting. Specifically, the velocity instruction value 201*a* is generated on the basis of the rotational velocity corresponding to the standard target velocity Vtar, the startup time ts, and the number of designated divisions (16 through 128), and the motors are controlled thereby. The control at the start up is executed as a slope-up process in step S201 in FIG. 6 by the motor drive control unit 200.

Next, the motor drive control unit 200 monitors the rotational velocities of the respective drive motors 102 and 112 based on the detection result of the encoder sensors 105, and determines whether the peripheral velocities of the photosensitive drum 101 and the intermediate transfer belt 111 reach the standard target velocity Vtar (step S202). When the peripheral velocities reach the standard target velocity Vtar (at the point t1 in FIG. 4), the motor drive control unit 200 sets an acceleration ending flag to ON (step S203).

Then, the motor drive control unit 200 performs the constant velocity control by a PID feedback control in step S204 so that the peripheral velocities of the photosensitive drum 101 and the intermediate transfer belt 111 are kept at the target velocity (the standard target velocity Vtar at the beginning).

Next, the motor drive control unit 200 determines whether the velocity change instruction was received from the image formation controller 500 in step S206. The velocity change instruction includes a switching instruction between the common constant velocity control and the differential peripheral velocity control (steps S107 and S111 in FIG. 5).

The motor drive control unit 200 proceeds with the process to step S207 when no velocity change instruction was received. On the other hand, when the velocity change instruction was received (at the points t2 and t5 in FIG. 4), the motor drive control unit 200 sets the velocity according to the new velocity instruction value 201*a* in step S205, and returns the process to the step S204.

In step S207, the motor drive control unit 200 determines whether a motor stop instruction (step S112 in FIG. 5) was inputted from the image formation controller 500. The motor drive control unit 200 returns the process to the step S204 until the motor stop instruction is inputted. On the other hand, when the motor stop instruction was inputted (at point t6 in FIG. 4), the process proceeds to step S208.

In the step S208, the motor drive control unit 200 suspends the driving of the drive motor 102 and 112. This operation is executed as a slope-down process that is opposite to the start up. Then, the process in FIG. 6 is completed.

Thus, the motor drive control unit 200 variably controls the peripheral velocities of the photosensitive drum 101 and the intermediate transfer belt 111 when the velocity instruction for setting the desired peripheral velocity difference is set as the velocity instruction value 201*a* from the image formation controller 500.

Next, the process in FIG. 5 will be described. When the image forming operation is started, the image formation controller 500 gives the drum/ITB driving start instruction for starting the drive motors 102 and 112 to the motor drive control unit 200 in step S101. Thereby, the motor drive control unit 200 starts the slope-up process (the step S201 in FIG. 6).

Next, the image formation controller 500 checks the states of the drive motors 102 and 112 in step S102, and determines whether the peripheral velocities of the photosensitive drum 101 and the intermediate transfer belt 111 reached the standard target velocity Vtar (acceleration was finished) in step S103. This is determined by monitoring the acceleration ending flag (the step S203 in FIG. 6) set up by the motor drive control unit 200 and by detecting that the acceleration ending flag was set to ON.

The image formation controller 500 repeats the process in the steps S102 and S103 until the acceleration is finished, and proceeds with the process to step S104 when the peripheral velocities reach the standard target velocity Vtar (the acceleration was finished at the point t1 in FIG. 4). In the step S104, the image formation controller 500 begins to drive the development motors Dev(Y, M, C, K)-M. Thereby, minute toner adheres to the photosensitive drum 101.

In the following step S105, the image formation controller 500 sets the predetermined period TLk to a peripheral velocity controlling timer. Then, the image formation controller 500 waits until the predetermined period TLk elapses (step S106), and gives an instruction of the differential peripheral velocity control to the motor drive control unit 200 in step S107 when the predetermined period TLk elapses (at the point t2 in FIG. 4).

This instruction changes the peripheral velocity of the photosensitive drum 101 to the drum velocity Vdrm faster than the standard target velocity Vtar. The motor drive control unit 200 changes the velocity in the step S205 in FIG. 6 when this instruction is received in the step S206, and shifts to the differential peripheral velocity control. Accordingly, the minute toner adheres to the drum surface from starting of the development motor, and the differential peripheral velocity control is started when the minute toner reaches the primary transferring position.

The motor drive control unit 200 changes the driving velocity of the intermediate transfer belt 111 shortly after the differential peripheral velocity control is started. However, since the velocity difference of before and after the change is about 0.3%, the control is stabilized within the stabilization period of several through several tens ms. Accordingly, as mentioned above, the laser scanner 100Y starts exposure after the stabilization period TLs from the point t2. The image formation controller 500 executes an image formation control (step S108) in parallel to the exposure, and determines whether the image formation was completed (step S109).

The image formation controller 500 returns the process to the step S107 until the image formation is completed. On the other hand, when the image formation is completed, the image formation controller 500 stops the development motors Dev(Y, M, C, K)-M (at the point t4 in FIG. 4) (step S110).

Next, the image formation controller 500 gives an instruction to finish the differential peripheral velocity control to the motor drive control unit 200 in step S111 after the period Tel elapses since the stop of the development motors (at the point t5 in FIG. 4). That is, the image formation controller 500 gives the instruction to return the peripheral velocity of the photosensitive drum 101 to the standard target velocity Vtar from the drum velocity Vdrm to the motor drive control unit 200. When receiving the instruction, the motor drive control unit 200 changes the control mode to the common constant velocity control that the standard target velocity Vtar becomes a common constant velocity from the differential peripheral velocity control (steps S206 and S205 in FIG. 6).

Next, the image formation controller 500 gives a motor stop instruction to the motor drive control unit 200 in step S112 after the period Te2 elapses (the point t6) from the process in the step S111. When receiving the instruction, the motor drive control unit 200 executes the slope-down process for stopping the drive motors 102 and 112 (the step S208 in FIG. 6). Then, the process in FIG. 7 is completed.

Thus, the peripheral velocity difference is set to zero under the no toner condition at the starting and before the slowdown of the drive motors 102 and 112, and the control mode is shifted to the differential peripheral velocity control at the timing when the minute toner reaches the primary transferring position. Thereby, the shock due to the increasing friction torque by a toner image is avoided, and the color misregistration due to the velocity fluctuation can be reduced. Moreover, the toner image transferred to the intermediate transfer belt is downscaled in the rotating direction of the intermediate transfer belt. When the downscaled toner image on the intermediate transfer belt is transferred to a sheet, the toner image is secondarily transferred to the sheet in enlarged fashion by matching the feeding velocity of the toner image with the peripheral velocity of the photosensitive drum. Otherwise, the exposure timing may be adjusted so as to form an enlarged electrostatic latent image on the photosensitive drum in consideration of the downscaling at the time of transferring to the intermediate transfer belt.

The result and meaning of the series of sequences executed by the image formation controller 500 and the motor drive control unit 200 will be described with reference to FIG. 8A and FIG. 8B.

Even if the photosensitive drum 101 and the intermediate transfer belt 111 are started under the velocity controls, the peripheral velocity difference (drum peripheral velocity>ITB peripheral velocity) at starting increases the load of drum and the peripheral velocity difference (drum peripheral velocity<ITB peripheral velocity) at starting increases the load of ITB. That is, the peripheral velocity difference at starting increases either of the driving loads.

Figure 8A:
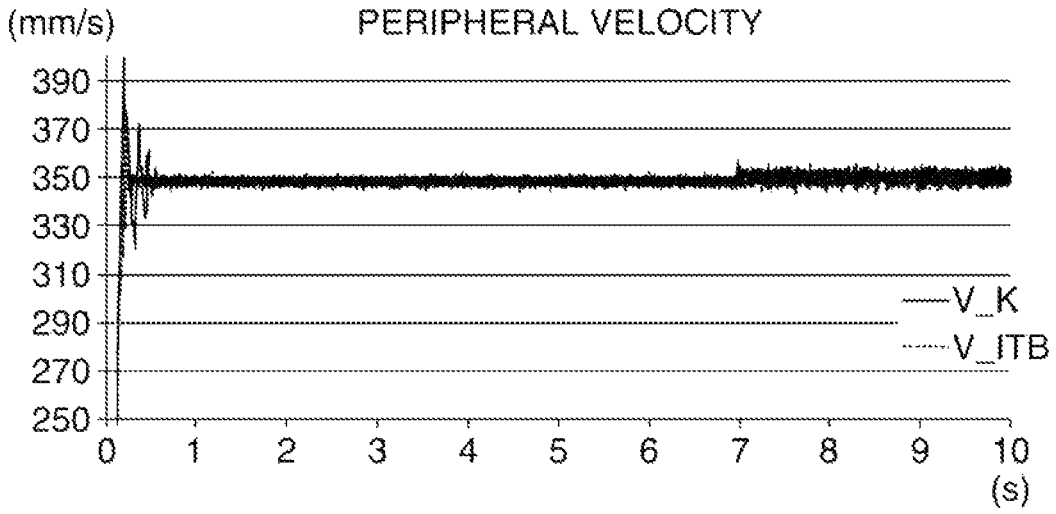
FIG. 8A is a graph showing variations of the peripheral velocity of the photosensitive drum and the peripheral velocity of an intermediate transfer belt in the embodiment where the peripheral velocity difference is zero at starting and becomes 0.3% after minute toner reaches the primary transferring position.
Figure 8B:
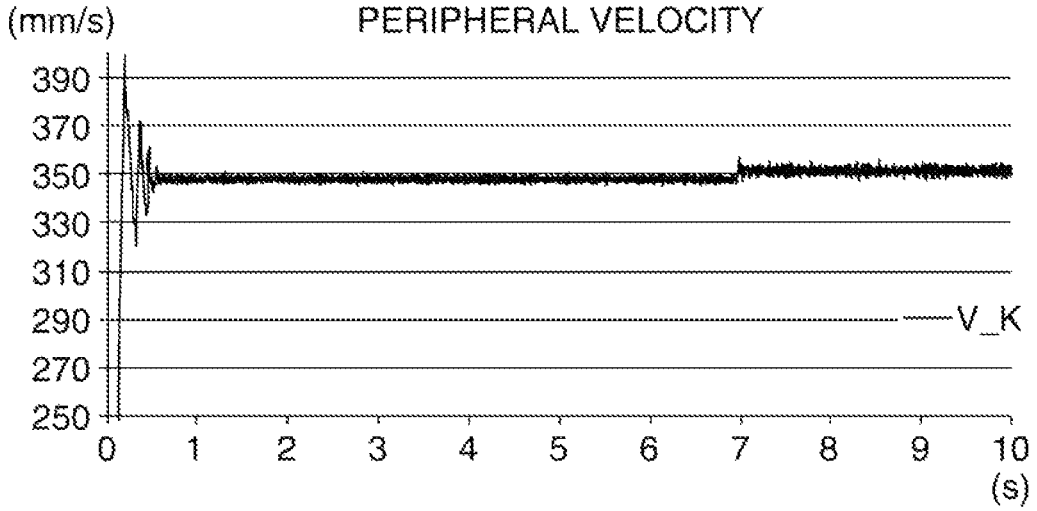
FIG. 8B is a graph showing only the peripheral velocity of the photosensitive drum picked out from FIG. 8A.
Figure 8C:
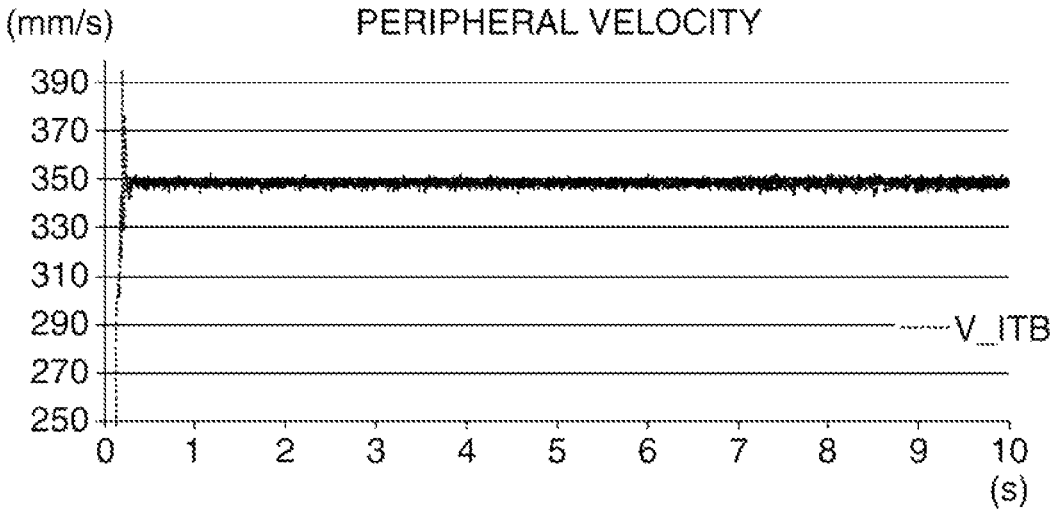
FIG. 8C is a graph showing only the peripheral velocity of the intermediate transfer belt picked out from FIG. 8A.
Figure 8D:
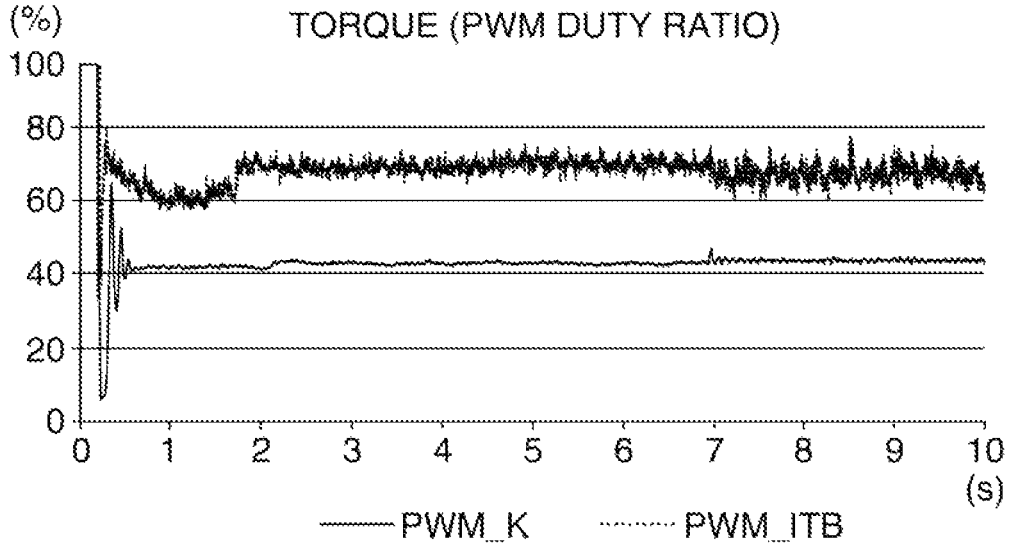
FIG. 8D is a graph showing variations of driving torque of the photosensitive drum and driving torque of the intermediate transfer belt corresponding to the variations shown in FIG. 8A.

FIG. 8A is a graph showing variations of the peripheral velocity of the photosensitive drum 101K (V_K) and the peripheral velocity of the intermediate transfer belt 111 (V_ITB) in the embodiment where the peripheral velocity difference is zero at starting and becomes 0.3% after the minute toner reaches the primary transferring position. Since the polygonal lines showing the peripheral velocities overlap and are hard to discriminate in FIG. 8A, the peripheral velocities are independently picked out and shown in FIG. 8B and FIG. 8C, respectively. FIG. 8B is a graph showing only the peripheral velocity of the photosensitive drum 101K picked out from FIG. 8A. FIG. 8C is a graph showing only the peripheral velocity of the intermediate transfer belt 111 picked out from FIG. 8A. FIG. 8D is a graph showing variations of driving torque of the photosensitive drum 101K (PWM_K) and driving torque of the intermediate transfer belt 111 (PWM_ITB) corresponding to the variations shown in FIG. 8A. Torque is shown as a duty ratio (%) of the PWM control.

Figure 9A:
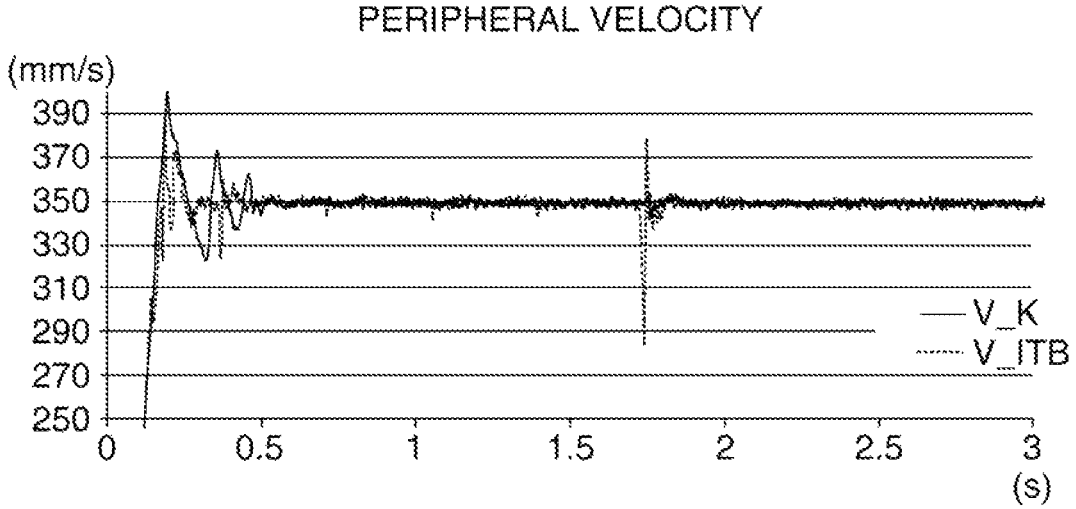
FIG. 9A is a graph showing variations of the peripheral velocities of the photosensitive drums and the peripheral velocity of the intermediate transfer belt in a comparative example where the peripheral velocity difference is set to 0.3% at starting.
Figure 9B:
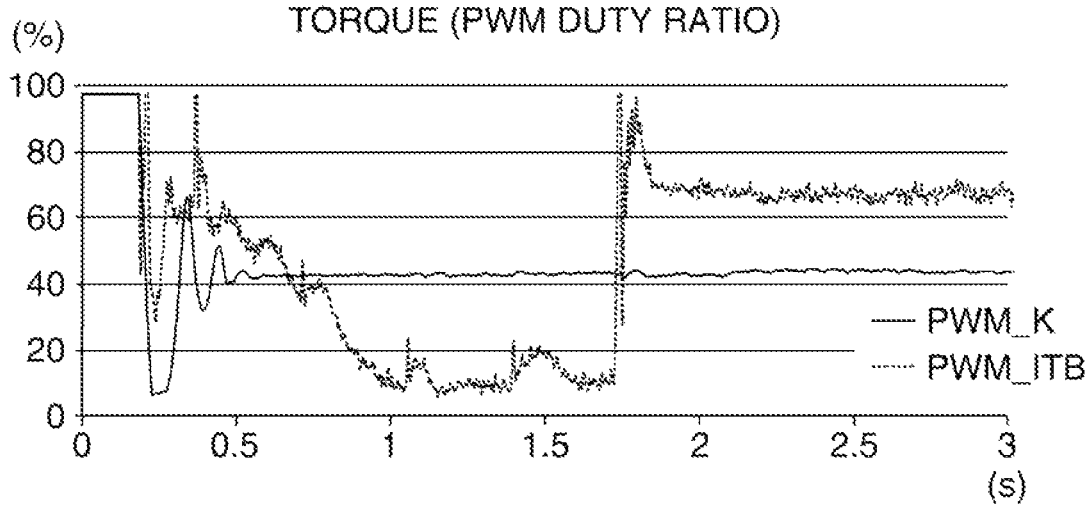
FIG. 9B is a graph showing variations of driving torque of the photosensitive drums and driving torque of the intermediate transfer belt corresponding to the variations shown in FIG. 9A.

FIG. 9A is a graph showing variations of the peripheral velocities of the photosensitive drums and the peripheral velocity of the intermediate transfer belt in a comparative example where the peripheral velocity difference is set to 0.3% at starting. FIG. 9B is a graph showing variations of driving torque of the photosensitive drums and driving torque of the intermediate transfer belt corresponding to the variations shown in FIG. 9A.

In the comparative example (the peripheral velocity difference at starting is set to a specified value (0.3%: the drum peripheral velocity>the ITB peripheral velocity)), the intermediate transfer belt 111 is pulled and driven by the photosensitive drum 101 under the no toner condition after reaching the constant velocity. This is understandable from the fact that the duty ratio of the ITB drive decreases to about zero level as shown in FIG. 9B. However, the intermediate transfer belt 111 is released from the condition where it is pulled by the photosensitive drum 101 at the instant of supplying toner, and the torque that the drive motor 112 for the intermediate transfer belt 111 should normally shoulder is applied to the drive motor 112 suddenly. Accordingly, the peripheral velocity of the intermediate transfer belt 111 varies sharply, which breaks the velocity control as shown in FIG. 9A. In the embodiment on the other hand, since the peripheral velocity difference is given after minute toner reaches the primary transferring position, the load torque that the intermediate transfer belt drive motor 112 should shoulder is always applied during the operation as shown in FIG. 8D, the range of fluctuation of torque is small and the velocity control functions effectively. As shown in the graphs, even when the peripheral velocity difference is given, the embodiment reduces the velocity fluctuation due to sharp variation of the friction torque depending on toner, and reduces the color misregistration.

According to the embodiment, the peripheral velocity difference between the photosensitive drum 101 and the intermediate transfer belt 111 is set to zero at the starting of the drive motors 102 and 112, and the differential peripheral velocity control starts after the predetermined period TLk elapses since the peripheral velocity difference becomes zero and the peripheral velocities are stabilized to be constant. The predetermined period TLk is the time required until a toner image formed on the photosensitive drum 101K reaches the primary transferring position from the image forming position.

The velocity fluctuation of the intermediate transfer belt 111 depending on toner at the starting of the image forming operation is thereby reduced. Moreover, since the peripheral velocity difference returns to zero after finishing the image formation and the drive motors 102 and 112 stop after that, the sharp velocity fluctuation of the intermediate transfer belt 111 depending on toner at the end of the image forming operation is reduced. Thus, since the sharp velocity fluctuation of the intermediate transfer belt 111 is avoided, the color misregistration is reduced.

Particularly, the reduction of the velocity fluctuation according to the present invention is effective to the intermediate transfer belt 111 that is made of an elastic member in order to acquire the improved imaging quality by improvements in the adhesion at the time of image transfer and in the dust resistance. That's because the large friction torque between the intermediate transfer belt 111 and the photosensitive drum 101 is large. What has a larger surface friction coefficient of the intermediate transfer belt 111 has a higher effect.

Although the peripheral velocity difference (the first value D1) between the photosensitive drum 101 and the intermediate transfer belt 111 in the common constant velocity control is set to zero (0) in the embodiment, it is not limited to zero as long as the reduction result of the velocity fluctuation of the intermediate transfer belt 111 is obtained. That is, the target peripheral velocity difference (the first value D1) in the period between the points t1 and t2 and in the period between the points t5 and t6 in FIG. 4 should be smaller than the setting peripheral velocity difference (the second value D2) in the differential peripheral velocity control in the period between the points t2 and t5, and may be larger than zero.

Although the differential peripheral velocity control of the embodiment increases the peripheral velocity of the photosensitive drum 101 while keeping the peripheral velocity of the intermediate transfer belt 111, the peripheral velocity of the intermediate transfer belt 111 may be changed as long as the peripheral velocity difference is appropriately controlled. Otherwise, the peripheral velocity of the intermediate transfer belt 111 may be increased instead of increasing the peripheral velocity of the photosensitive drum 101.

It should be noted that the setting peripheral velocity difference D2 in the differential peripheral velocity control may be grasped by ratio instead of difference.

Although the embodiments of the invention have been described, the present invention is not limited to the above mentioned embodiments, the present invention includes various modifications as long as the concept of the invention is not deviated.

OTHER EMBODIMENTS

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above described embodiment(s). For this purpose, the program is provided to the computer for example via a network or from a recording medium of various types serving as the memory device (e.g., computer readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-102874, filed on Apr. 27, 2012, which is hereby incorporated by reference herein in its entirety.

What is claimed is:

1. An image forming apparatus comprising:

an exposure unit configured to form a latent image on an image bearing member;

a development unit configured to develop the latent image to form a toner image;

a primary transfer unit configured to transfer the toner image formed on the image bearing member to an intermediate transfer medium;

a secondary transfer unit configured to transfer the toner image transferred to the intermediate transfer medium to a sheet;

a first drive unit configured to rotate the image bearing member;

a second drive unit configured to rotate the intermediate transfer medium; and a control unit configured to control said first and second drive units so that a peripheral velocity difference between the image bearing member and the intermediate transfer medium becomes a first value when driving of said first and second drive units is started, and configured to control said first and second drive units so that the peripheral velocity difference becomes a second value larger than the first value when toner, which is adhered to the image bearing member by said development unit being operated, reaches the position of said primary transfer unit.

2. The image forming apparatus according to claim 1, wherein said control unit controls said first and second drive units so that the peripheral velocity difference becomes the second value after a predetermined period elapses since the peripheral velocity difference becomes the first value and the peripheral velocities are stabilized to be constant, and wherein the predetermined period is the time required until a toner image formed on the image bearing member reaches the primary transferring position from an image forming position according to rotation of the image bearing member.

3. The image forming apparatus according to claim 1, wherein said control unit controls said first and second drive unit so as to switch the peripheral velocity difference from the second value to the first value after finishing image formation, and stops said first and second drive units after the peripheral velocity difference becomes the first value.

4. The image forming apparatus according to claim 1, wherein the intermediate transfer medium is made of an elastic member.

5. The image forming apparatus according to claim 1, wherein the first value is zero.

6. An image forming apparatus comprising:

an exposure unit configured to perform an exposure operation to form a latent image on an image bearing member;

a development unit configured to develop the latent image to form a toner image;

a primary transfer unit configured to transfer the toner image formed on the image bearing member to an intermediate transfer medium;

a secondary transfer unit configured to transfer the toner image transferred to the intermediate transfer medium to a sheet;

a first drive unit configured to rotate the image bearing member;

a second drive unit configured to rotate the intermediate transfer medium; and a control unit configured to control said first and second drive units so that peripheral velocities of the image bearing member and the intermediate transfer medium become equal when driving of said first and second drive units is started, then, to start the operation of said development unit before said exposure unit starts the exposure operation, and to control said first and second drive units so as to increase at least one of the peripheral velocities of the image bearing member and the intermediate transfer medium during image formation.

7. The image forming apparatus according to claim 6, wherein said control unit controls said first and second drive units so as to increase one of the peripheral velocities after a predetermined period elapses since the peripheral velocities are stabilized to be constant, and wherein the predetermined period is the time required until a toner image formed on the image bearing member reaches the primary transferring position from an image forming position according to rotation of the image bearing member.

8. The image forming apparatus according to claim 6, wherein said control unit controls said first and second drive unit so that the peripheral velocities of the image bearing member and the intermediate transfer medium become equal after finishing the image formation, and stops said first and second drive units after the peripheral velocities become equal.

9. The image forming apparatus according to claim 6, wherein the intermediate transfer medium is made of an elastic member.

10. A control method for an image forming apparatus that is provided with a first drive unit for rotating an image bearing member and a second drive unit for rotating an intermediate transfer medium, and that primarily transfers toner images that are formed by developing latent images formed by exposure units by development units onto the intermediate transfer medium in piles and secondarily transfers the primarily transferred toner images to a sheet, the control method comprising:

a step of controlling the first and second drive units so that a peripheral velocity difference between the image bearing member and the intermediate transfer medium becomes a first value when driving of said first and second drive units is started;

a step of starting the operation of the development units after starting driving of the first and second drive units;

a step of starting the operation of the exposure units after a predetermined time elapses from when starting driving of the development units; and a step of controlling the first and second drive units so that the peripheral velocity difference becomes a second value larger than the first value when toner, which is adhered to the image bearing member by said development unit being operated, reaches a position at which toner is primarily transferred.

11. The control method for the image forming apparatus according to claim 10, further comprising:

a step of controlling the first and second drive units so as to switch the peripheral velocity difference from the second value to the first value after finishing image formation; and a step of stopping the first and second drive units after the peripheral velocity difference becomes the first value.

12. A control method for an image forming apparatus that is provided with a first drive unit for rotating an image bearing member and a second drive unit for rotating an intermediate transfer medium, and that primarily transfers toner images that are formed by developing latent images formed by exposure units by development units onto the intermediate transfer medium in piles and secondarily transfers the primarily transferred toner images to a sheet, the control method comprising:

a step of controlling the first and second drive units so that peripheral velocities of the image bearing member and the intermediate transfer medium become equal when driving of said first and second drive units is started;

a step of starting the operation of the development units after starting driving of the first and second drive units;

a step of starting the operation of the exposure units after a predetermined time elapses from when starting driving of the development units; and a step of controlling the first and second drive units so as to increase at least one of the peripheral velocities of the image bearing member and the intermediate transfer medium during image formation.

13. The control method for the image forming apparatus according to claim 12, further comprising:

a step of controlling the first and second drive units so that the peripheral velocities of the image bearing member and the intermediate transfer medium become equal after finishing the image formation; and a step of stopping the first and second drive units after the peripheral velocities become equal.

* * * * *